United States Patent [19]

Cook

[11] 4,415,976

[45] Nov. 15, 1983

[54] METHOD AND APPARATUS FOR AUTOMATIC MILL ZERO CORRECTION FOR STRIP WIDTH

[75] Inventor: John W. Cook, Williamsville, N.Y.

[73] Assignee: Westinghouse Electric Corp., Pittsburgh, Pa.

[21] Appl. No.: 258,342

[22] Filed: Apr. 28, 1981

[51] Int. Cl.[3] ..... G06F 15/46; B21B 37/00

[52] U.S. Cl. ..... 364/472; 72/8; 72/16

[58] Field of Search ..... 364/472, 468, 469, 164, 364/165; 72/6, 7, 8, 9, 10, 11, 12, 16

[56] References Cited

U.S. PATENT DOCUMENTS

| | | | |
|---|---|---|---|
| 3,404,550 | 10/1968 | Plaisted | 72/8 |
| 3,592,030 | 7/1971 | Smith, Jr. | 364/472 X |
| 3,709,008 | 1/1973 | Smith, Jr. | 72/8 |
| 3,766,761 | 10/1973 | Adair et al. | 72/8 |
| 4,323,971 | 4/1982 | Moltner et al. | 364/472 X |

*Primary Examiner*—Joseph F. Ruggiero
*Attorney, Agent, or Firm*—C. M. Lorin

[57] ABSTRACT

The change in the mill modulus of the stand of a rolling mill due to the particular strip width of a run strip of material is taken into account by reference to the unloaded mill modulus of the stand and a desired roll gap opening is calculated on the basis of an error relative to the actual roll gap opening in order to achieve a desired strip thickness setting.

19 Claims, 9 Drawing Figures

METHOD AND APPARATUS FOR AUTOMATIC MILL ZERO CORRECTION FOR STRIP WIDTH

BACKGROUND OF THE INVENTION

The invention relates to automatic gauge control of rolling mills, in general, and more particularly to a system for calibrating the roll force applied to the roll stands of a rolling mill.

Automatic gauge control of thickness reduction through one or more stands of a rolling mill rests upon a mass flow relationship between speed and thickness through all the stands. Actual performance of a roll stand in relation to speed and roll force depends upon the initial setting of the roll stand from an empty and unloaded condition to a well-identified preloaded condition to throughout the transformation process. The schedule may be calculated by a computer. If, however, a computer is not used, the mill setup must be made by the mill operator. In such case, a precise and easily performed mill setup with the assist of an operator could be of much benefit on non-computer mills having a sophisticated system of hydraulic automatic gauge control, by advantageously providing additional "on-gauge" performance. Moreover, an improved mill setup system would add, to the many hot strip mills in existence for many years, the capability of producing products having a quality comparable to what is now obtained with many of the newer mills. The existing manufacturers would thus be able to extend the useful life of their manufacturing equipment without having to invest in more modern rolling mill installations.

For mills which have fast acting roll gap actuators, such as hydraulic cylinders, it is possible and practical to calibrate the stand roll gaps every time that a schedule change is to be made. One method of calibrating is to:

(1) predict the stand roll force for the new schedule.

(2) close the roll up gap below face to obtain the predicted roll force with no strip in the mill.

(3) open the roll gap from this preloaded position by exactly the thickness of the desired delivered strip thickness from this stand.

The above setup procedure will produce on gauge strip provided the predicted roll force is correct and also provided the mill modulus with strip in the mill is the same as the mill modulus with no strip through the mill stands.

In any given work roll position relative to strip material being passed through the stand, there is a stand roll force RF, a stand screwdown or hydraulic cylinder position S establishing a roll gap opening H for the processed materials and these parameters are related by the formula.

$$H=RF/M+S$$

where M is the known mill spring modulus of the rolling stand.

When a change in the roll gap opening takes place, the differential relation is as follows:

$$\Delta H=\Delta RF/M+\Delta S.$$

While the workpiece delivery gauge is determined by the equilibrium point where the roll force of the rollstand is equal to the force required to deform the product, several factors intervening as changing parameters may make the basic equation invalid. For instance the plasticity of the strip material may have to be taken into account. This factor has been given consideration in the rolling gauge control mill method and apparatus of U.S. Pat. No. 3,709,008 of A. W. Smith. Another factor is the working roll curvature. The shape and the thickness of the workpiece strip delivered from a rolling mill are determined, according to U.S. Pat. No. 3,404,550 of R. G. Plaisted, by a controlled sending of the work rolls, and any workpiece strip shape error is corrected in order to obtain the desired delivery thickness.

Instead of using as in the Plaisted patent, bending force transducers to generate a control signal effective on a bending force control device together with bending compensation operative on the roll positions, the present invention proposes to effectuate correction at the preloading stage of the stand in such a way as to take into account the strip width which is a major factor in causing the work rolls to bend, particularly when the strip width is narrow. In this respect, it is realized that the applied roll force is not distributed over the entire width of the upper work roll, whereas the back-up roll maintained at two ends by its support tends to deflect the rolls at the extreminities. As a result, the mill modulus is $M_2$ which is different from the mill modulus $M_1$ when the stand is empty.

In this respect, it is realized that the roll force from the screwdown or hydraulic cylinder is not distributed over the entire length of the upper work roll when the material strip is narrow, is interposed in the gap only toward the center of the rolls, whereas the support or reacting forces applied on the arcs of the lower roll, are toward the extremities, tending to deflect the bottom roll from the ends, thereby causing roll bending.

It has been shown, for instance in the aforementioned U.S. Pat. No. 3,709,008 of A. W. Smith, Jr., that the mill modulus of the rolling stand is a constant used by automatic gauge control systems in estimating the roll force and the gauge, and that such constant is the inverse slope of the mill characteristic curve. The mill modulus is known to be affected by the width of the strip of material being rolled. Accordingly, when setting up a stand on an empty mill, a change of modulus can be expected as a function of strip width. Therefore, for a given total roll force estimated, a change in strip width will result in a change in the deflection of the rolls, even if the mill housing deflection should remain constant. The total mill deflection is the sum of all the deflections experienced by the several mill stand parts, the total discrepancy could be quite substantial. It is known from experience, as well as from calculations, that variations in strip width from maximum to minimum width may affect the total modulus by as much as 15% to 25% depending upon mill width and roll diameters.

The present invention provides for automatic gauge control of a rolling mill in which the mill can be set up so that variation in the mill modulus as a function of width of the strip is automatically computed and compensated for.

The present invention also provides for automatic zero-correction of error due to strip width variation in the initial setup of a rolling mill.

The present invention moreover provides an improved and easier setup of a rolling stand for a better and more precise performance under automatic gauge control.

The present invention further improves the operation of an electrohydraulic roll force control system of a rolling mill through the provision of a better and more precise setup system.

SUMMARY OF THE INVENTION

A method of calibrating the roll gaps at the various stands of a rolling mill when the schedule of operation is to be changed by first closing the roll gap below face to establish a preloaded condition for a desired roll force without running strip material, then, opening the roll gap by the desired thickness, DT under a prospective schedule and establishing a quantity $$\Delta S = RF/M_1 - RF/M_2$$

for the desired roll force with moduli $M_1$ for the empty mill condition and $M_2$ for a loaded mill condition corrected by the width of the strip to be run and modifying the roll gap position by an amount equal to $(DT-\Delta S)$.

The quantities $M_1$, $M_2$, $\Delta S$ and $(DT-\Delta S)$ are established by reference to the desired roll force RF with the assist of analog circuitry and most advantageously with microprocessor hardware.

DESCRIPTION OF THE PREFERRED EMBODIMENT

Figure 1:
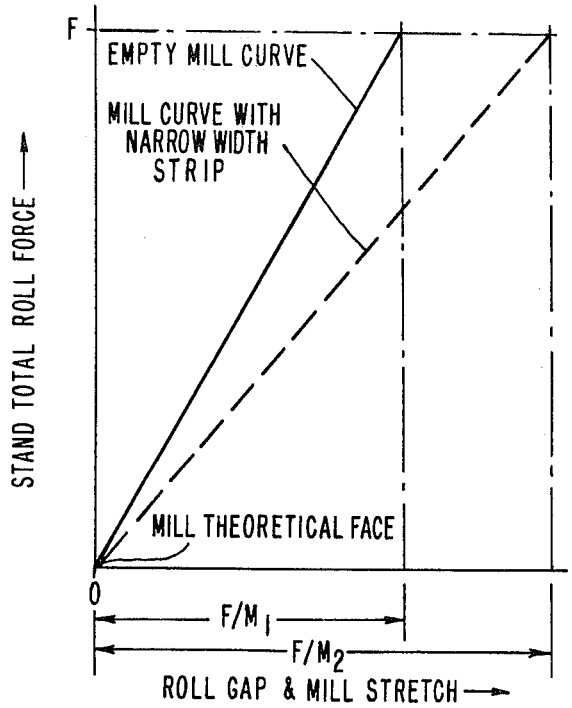
FIG. 1 shows a typical mill curve characteristic of a roll stand as used in a roll force automatic strip thickness control system.

FIG. 1 shows in solid line a mill curve characterizing the operation of a typical roll force automatic strip thickness control system. This curve is a straight line drawn in accordance with the well-known equation for straight deformation: $h=S_O+F/M$ where h is the delivery gauge or thickness of the rolled workpiece strip, $S_O$ is the separation of the rolls when the mill is empty, F equals the roll force and M is the mill spring constant.

The origin O represents the mill theoretical face, e.g., when the rolls are touching, for zero roll force. Preloading of the roll force control system (with a screwdown mechanism or electrohydraulic system) corresponds to a roll force F when the roll stand is empty, e.g. a setting for which the separation of the rolls is $F/M_1$ rather than zero. In such case, the operator is said to initiate the rolls to move below face by the quantity $F/M_1$ to obtain the desired roll force F. Such a curve is called a modulus curve. The modulus curve will vary in slope when a strip is passed into the stand. For the same force F, the modulus will vary with the width of the strip. The curve in dotted lines represents an extreme situation, namely the modulus curve for the narrowest width strip. The wider widths would establish a modulus curve in between the two slopes illustrated in FIG. 1. $F/M_2$ is the separation of the rolls for the same roll force F on the dotted line curve.

Figure 2:
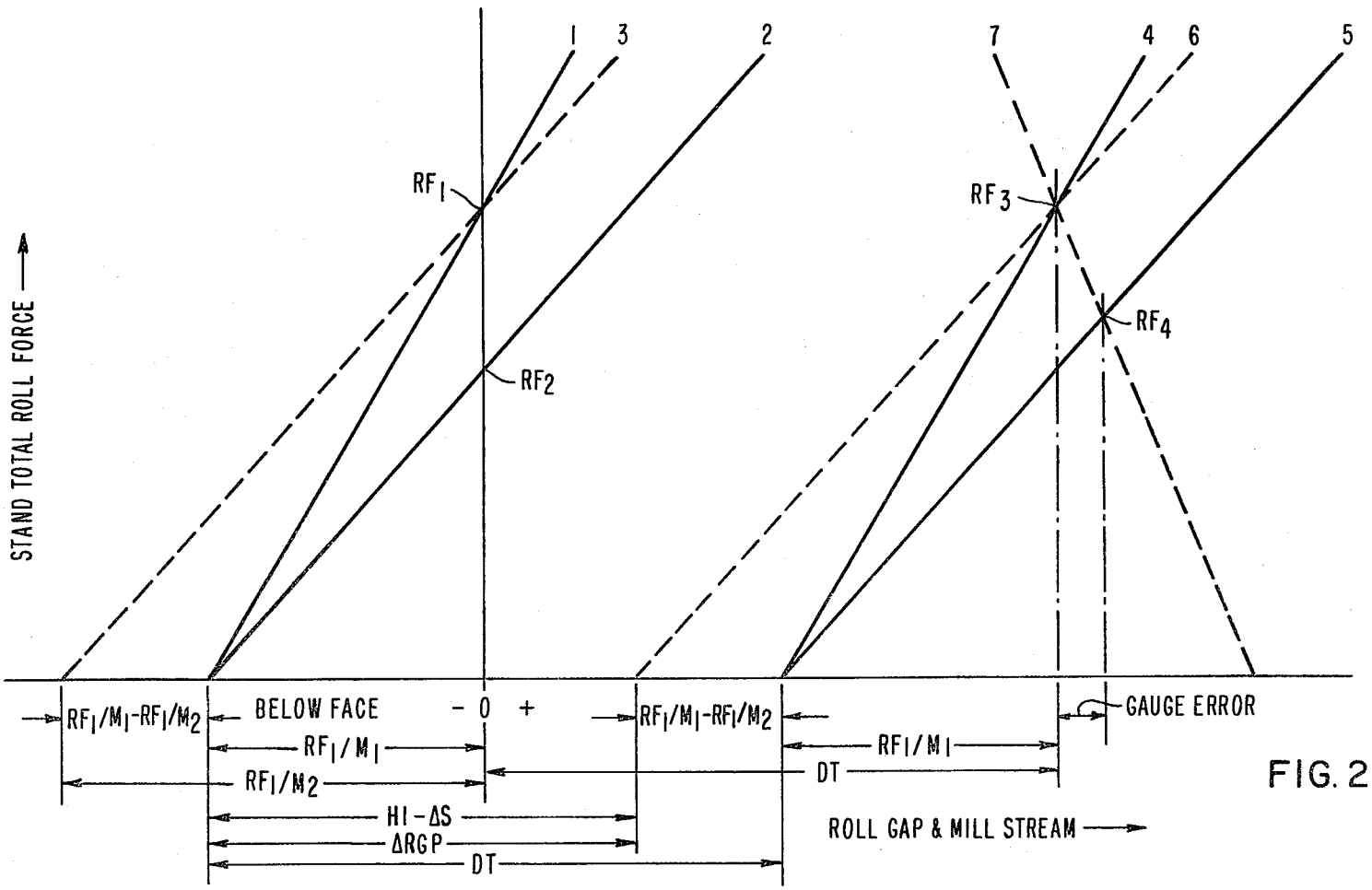
FIG. 2 illustrates with curves the moduli for a given strip width when the strip width is not taken into account and indicates the gauge error which appears when this is not taken into account.

Referring now to FIG. 2, operation of the rolling mill is illustrated for one stand by: the $M_1$ for an empty mill and a roll gap separation of $-RF_1/M_1$ at roll force $RF_1$ (curve #1). The modulus for a given strip width becomes $M_2$ (curve #2) for the same force $RF_1$, and the roll gap separation is $-RF_2/M_2$.

The roll force $RF_1$ is either known or estimated by the operator. The roll gap is closed below face along the empty mill modulus (curve #1). The operator starts working the rolls below face until the value $RF_1$ is obtained. This will correspond to being below face by the amount $RF_1/M_1$. However, when a strip is in the mill stand, it is known that the strip width will cause the stand modulus to be $M_2$, in fact, as shown by curve #2. Ignoring this fact, the operator will normally open the roll gap by exactly the desired thickness DT. The movement will be +DT, which results in a position given by $S_O=DA=(+DT-RF_1/M_1)$. At this position the empty mill modulus is represented by curve #4 parallel to curve #1 but translated by +DT, the desired thickness. However, the correct setup width curve is in fact a curve #5 translated by the same amount form curve #2. If curve #7 in dotted line represents the dynamic characteristic of the material being rolled, it intersects curve #4 at the ordinate $RF_3$ and curve #5 at the ordinate $RF_4$. The gauge error is defined between the abscissa DT of $RF_3$ on-gauge and the abscissa of $RF_4$.

The object of the present invention is to automatically compensate for the gauge error due to the additional deflection of the rolls for a strip material of less than full width. The rationale for such compensation is as follows:

Curve #6 in dotted line is parallel to curve #5. It shows on the zero roll force axis that the error relative to curve #4 is due to an initial roll gap $S_O=OA$ rather than $S_1=OB$, if it were on curve #6 when the rolling load curve #7 intersects curve #6 e.g. exactly at the ordinate $RF_3$ for an abscissa value of DT, e.g., with zero gauge error. Since curve #4 is obtained by a translation from curve #1 of amplitude DT, A is defined by $OA=DT-RF_1/M_1$. Since curve #5 is obtained by a translation DT from curve #2, curve #6 is in fact a curve translated from the curve #2 by the amount $DT+(RF_1/M_1-RF_1/M_2)$. Then, the abscissa of B lies at $(RF_1/M_1-RF_1/M_2)$ from A, which is the error to be compensated for when setting up the mill stand. This relation shows that the ambiguities between curves #1 and #2 expressed at the origin (0) with the curves of FIG. 2 by the expression $RF_1/M_1=RF_2/M_2$ has been resolved in terms of the desired roll force $RF_1$ and the two moduli $M_1$ and $M_2$ with curves #6 and #5.

Figure 3A:
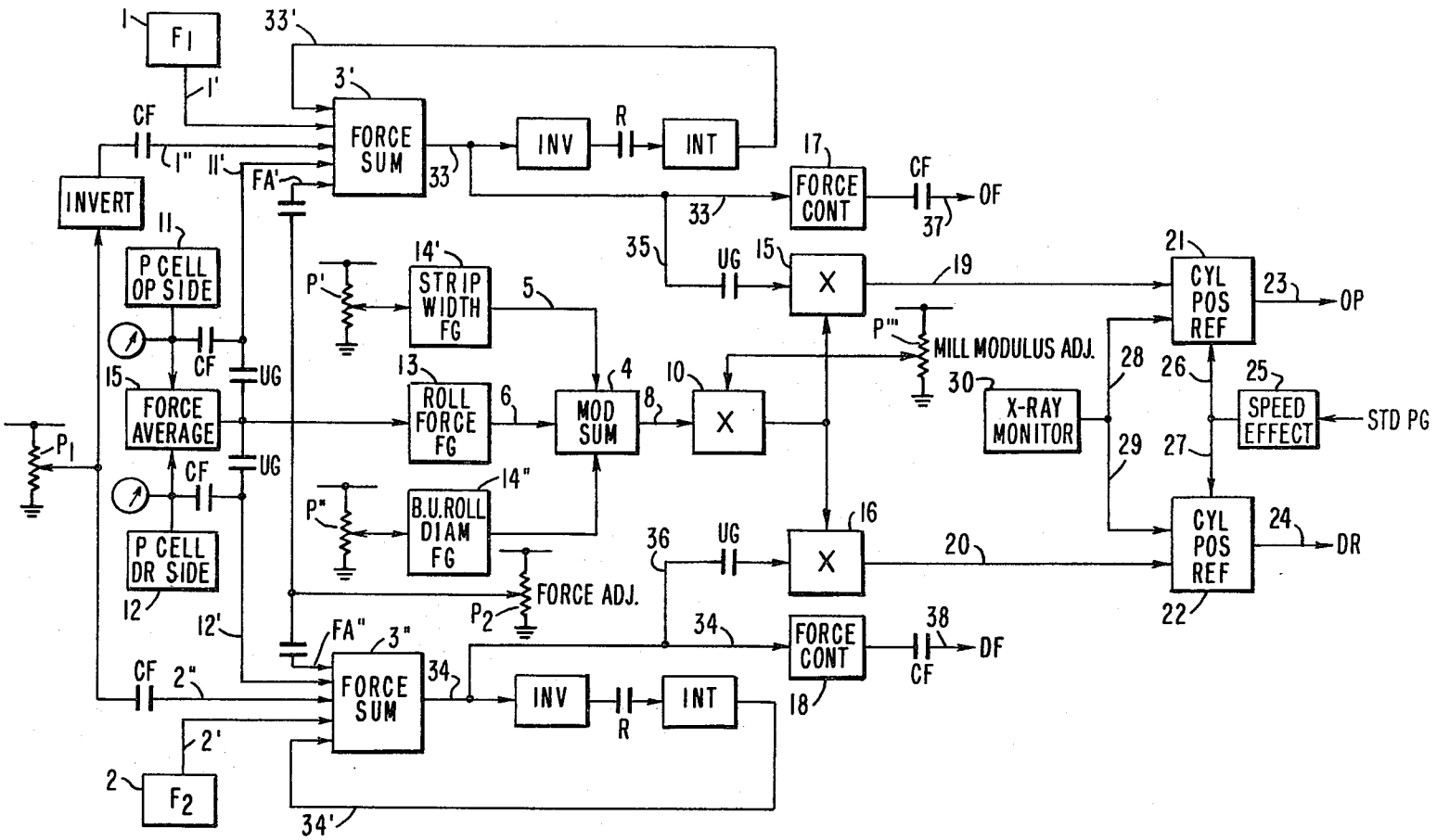
FIGS. 3A and 3B illustrate in block diagram an electrohydraulic gauge control system of the prior art as can be modified to implement the present invention.
Figure 3B:
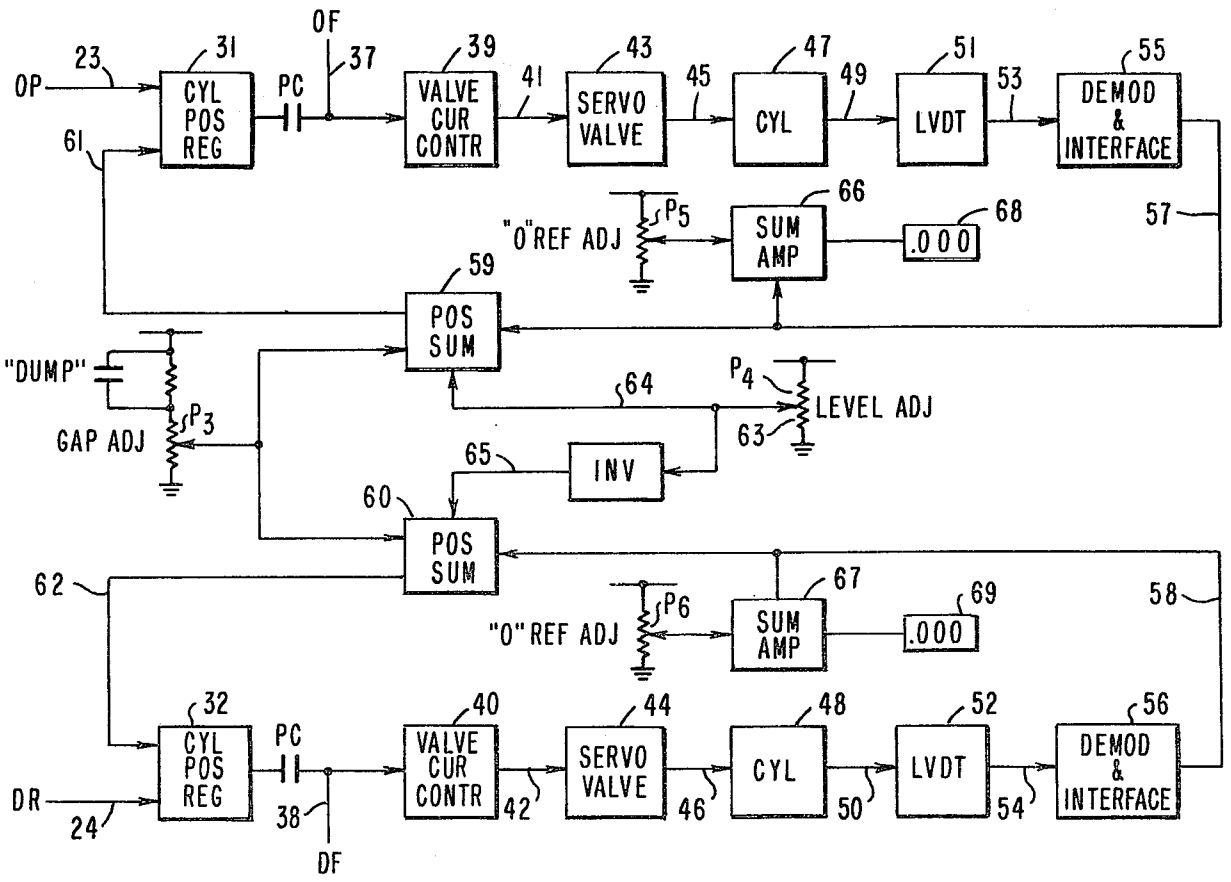

FIGS. 3A and 3B illustrate in block diagram an electrohydraulic system of the prior art used for applying a controlled roll force on the operator (OP) and drive (DR) sides of the rolls of a mill stand.

Figure 4:
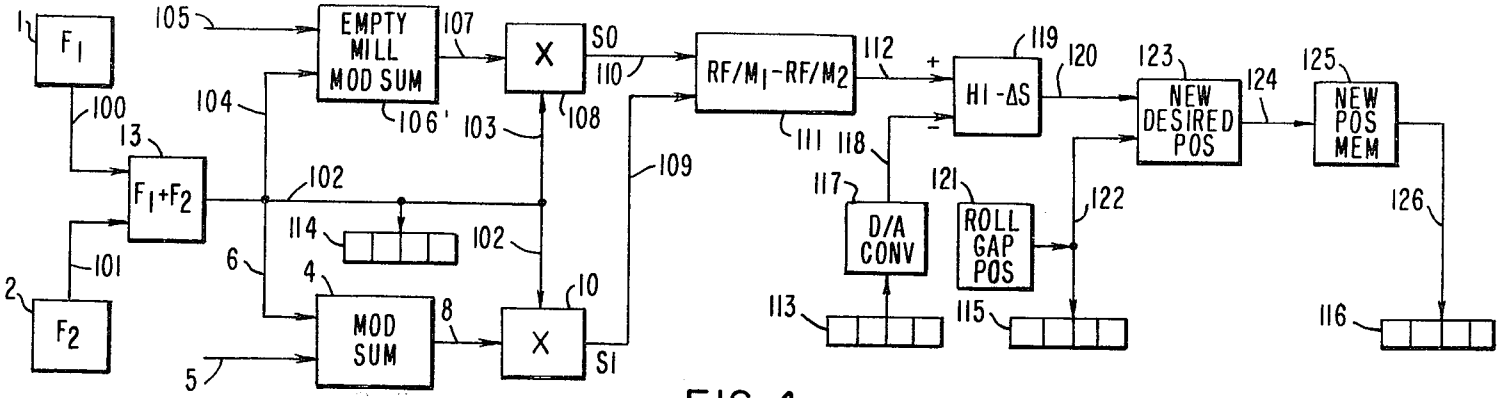
FIG. 4 shows in simplified form how the prior art system of FIGS. 3A and 3B can be modified to implement the present invention.
Figure 5:
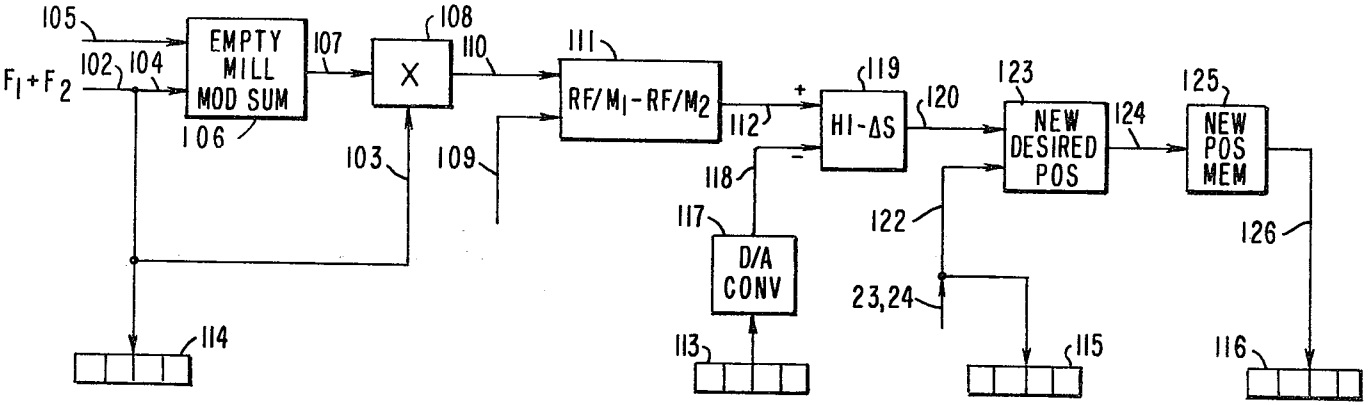
FIG. 5 shows the new functions which need only to be added to the prior art system of FIGS. 3A, 3B to implement the present invention.

FIG. 4 shows in block diagram how the basic concept of the invention can be implemented. FIG. 5 illustrates how the circuit of FIGS. 3A and 3B can be modified in order to allow for setting to a predetermined roll force and backing off by the desired thickness of the strip, in accordance with the present invention .

Referring to FIG. 3A, the roll gap is controlled by applying hydraulic forces to the cylinders associated with the operator (OP) side and the drive (DR) side of the working rolls. The forces developed by the cylinders are detected by load or pressure cells symbolized by blocks 11 and 12 on the operator and drive sides, respectivley. The pressure cells associated with the (OP) and the (DR) sides, indicated by blocks 11 and 12, provide signals representative of the force exerted on the rolls. The average roll force represents the total separating force distributed all along the work roll. It is derived by block 15 from the output of pressure cells 11 and 12. A function generator 13' is provided in order to take into account at the output of roll force average 15 the nonlinearity of the modulus curves in the low roll force region. Thus, function generator 13' is responsive to the average force signal outputted by averager block 15'. The outputted singal on line 6 is representative of roll force RF on the modulus curve of FIG. 1 or FIG. 2. The effective roll force RF is further modified in order to take into account the width of the strip. This is done by function generator 14'. The back-up roll diameter is also taken into account by function generator 14'. Respectivepotentiometers P', P'' define the respective amounts of correction so introduced. The corrective signals on line 5 from function generator 14'and on line 7 from function generator 14'', are summed up with the roll force representative signal on line 6 from function generator 13'. Mill modulus adjustment defined by a potentiometer P''' is combined with the signal of line 8 from summer 4 in a multiplier 10.

Given a roll force initially established and translated by signals on lines 11', 12' to respective summers 3', 3'', the roll forces are balanced out by the action of the inverters and integrators operating as zeroing devices. Summers 3' and 3'' each have a closed loop between the output line (33 or 34) and a feedback input (33' or 34'). Each closed loop includes an inverter (INV) and an integrator (INT) whereby any variation at the input side will very quickly be established at the output side of the summer. A short time after the strip enters the mill relay R is opened so that the initial force is held in memory by the integrator. During rolling variations at the outputs 33, 34 of summers 3', 3'', due to a change in measured roll force, will appear readily on lines (33, 34)to respective force controllers 17, 18 of the OP and DR side control channels, or on lines 35, 36 to multiplier 15, 16 of the respective channels. Multipliers 15, 16 are also responsive to the output signal from a multiplier 10 associated with the modulus summer 4 and line 8 therefrom, in the roll force information control channel which is common to both working roll sides and characteristic of the roll force RF on the modulus curve.

Also given in relation to the modulus curve of FIG. 1 or 2, is the thickness at the output of the mill or delivery gauge provided by the X-ray monitor 30. The automatic gauge control system is responsive on lines 28 and 29 to X-ray monitor 30 which detects the delivery gauge of the strip material and provides a thickness error signal. Such error signal is derived, for each side of the roll stand, by comparing the signal to line 28 or 29 with the signal outputted on line 19, or 20, from the associated multiplier 15 or 16. As a result, any change in the roll force manifested on lines 35 and 36, is translated into cylinder displacement in the hydraulic system by blocks 21, 22 which are reference summers providing error signals, at the output 23, or 24, which are representative of position error in the cylinder of the hydraulic system. Cylinder position reference blocks 21, 22 are also controlled from speed effect block 25 and lines 26, 27 respectively, so as to compensate for speed effect in such displacement or positioning of the work rolls under the adjustment hydraulic force.

Referring to FIG. 3B, the error signals from lines 23 (on the (OP) side) and 24 (on the (DR) side) are inputted into respective cylinder positioning regulators shown as blocks 31 and 32. These positioning regulatros 31, 32 are normally not effective at the output because of break contacts of a relay PC (not shown). When the relay is actuated the outputs of blocks 31, 32 are fed into a valve current controller (39 on the OP side, 40 on the DR side). The valve current controllers can be actuated, from lines 37 and 38, respectively to respond to the roll force change from the force controllers (17 on the (OP) side, 18 on the (DR) side) which are controlled by the signals of lines 33 and 34, respectively, (FIG. 3A). Thus, the signals from cylinder positioning regulators 31 and 32 are used to modify the operation of the valve current controllers 39, 40 in accordance with roll displacement as well as in accordance with roll force. The intent is to allow for a force controller, or a strip thickness control, depending on which is selected by the operator. The usual control channel for each work roll side includes a servo-valve (43 on the (OP) side, 44 on the (DR) side) and the cylinder proper (47 or 48). Cylinder operation is translated into actual displacement for each side by block LVDT (51 or 52) and (after demodulation and interface by respective blocks 55, 56) leading by line 57, or 58 in to a summer amplifier (66 or 67) in each channel. Actual position is displayed digitally at 68, or 69, by reference to a zero point given for each side by respective potentiometers P5, P6 which are inputting into the corresponding summer amplifier (66, or 67).

The two positioning channels of lines 57 and 58 go through the associated position summer (59, or 60) via respective lines 61, 62, and end into cylinder positioning regulator 31 or 32, thus forming a closed loop in each channel. Position summers 59, 60 are in parallel on a roll gap adjusting potentiometer $P_3$ which provides zero balancing for the two channels. A level adjusting potentiometer $P_4$ also provides signal balancing between the two closed loops by line 64 to position summer 59 and, via line 63, an inverter and line 63, to position summer 60.

FIG. 4 illustrates the preferred embodiment of the invention, e.g., one way of implementing a precise and easy initial setting of a roll stand with the assist of a mill operator.

The roll forces F1 and F2 are translated into signals by blocks 1 and 2 which feed by lines 100, 101 into the force averager block 13. By line 102 the average force $F_1/2+F_2/2$ is displayed digitally at 114. As explained by reference to FIG. 3A and as schematically shown in FIG. 4 by blocks 4 and 10 for the sake of simplicity, the roll force function signal of line 6, the back-up roll diameter function signal of line 7 and the strip width function signal of line 5 are combined in modulus function summer 4, while multiplier 10 combines the outputted signal of line 8 with the roll force $RF_2$ signal of line 102 to provide a signal on line 109 which is representative of the mill stretch $RF/M_2$ in accordance with the dotted line of FIG. 1, or curve 2 of FIG. 2. The roll force signal of line 102 is also applied via line 104 to a modulus function summer 106 which relates to the empty mill e.g. when no strip is passed through. Back-up roll diameter correction, like on line 5 to modulus function summer 4 of FIG. 3A, is fed by line 105 into the empty mill modulus summer 106. The output on line 107 is in accordance with the solid line of FIG. 1, or curve #1 of FIG. 2, which when combined in a multiplier 108 with the roll force RF of FIG. 1, or $RF_1$ of FIG. 2, provides at its output 110 the empty mill roll gap ($RF/M_1$). Lines 109 and 110 are inputted into a subtracter 111 to provide $BA=S_0-S_1=\Delta S=(RF/M_1-RF/M_2)$. This quantity $\Delta S$, which will always be negative, is inputted by line 112 into a summer 119 where it combines with the desired thickness (DT) derived from line 118 as set by the operator on a digital thumbwheel 113. The digital value of DT set on thumbwheel 113 is converted by D/A converter 117 into an analog signal outputted on line 118. Thus, if $\Delta S=(RF/M_1-RF/M_2)$ is on line 112 and DT is on line 118, summer 119 provides $DT-\Delta S=\Delta RGP$, e.g., the desired change in roll gap positioning. Roll gap position RGP, as it stands, is given by a roll gap position sensor 121 and displayed digitally at 115 by a digital voltmeter. The RGP signal on line 122 is added to the desired change in roll gap positioning signal $\Delta RGP$ of line 120 thereby to provide, via a summer shown by block 123, a new desired position signal outputted on line 124 which can be stored into a memory 125, then, displayed at 116 as derived on line 126 from memory 125.

As a result, the operator can easily set on the thumb wheel at 113 the desired strip thickness. Knowing at 115 the actual roll gap position, he observes at 116 the desired roll gap position which he can set up so that the roll force will become $RF_3$ rather than $RF_4$ (FIG. 2) once the hydraulic system has been set up by 68 and 69 (FIG. 3B) to the desired roll gap positioning level.

To summarize the operation of the system of FIGS. 3A, 3B and 4 is as follows:

In order for the mill to be properly set, the opening of the roll gap set in accordance with the predicted force must be corrected so as to take into account the difference in the mill stretch for the two different moduli for the force used to preset. This is done at 4 and 106 (FIG. 4). As shown on curve #2 of FIG. 2, the correction corresponds to a quantity represented by $RF/M_1$-$RF/M_2$ where RF is the preloaded force, $M_1$ is empty mill modulus and $M_2$ is correct width modulus.

The basic system of FIGS. 3A, 3B is modified to allow resetting to a predetermined force and backing off by the desired thickness of the strip through the two modulus summers 4 and 106. One is a conventional unit with inputs one for back-up roll diameter, one for stand roll force and one for strip width. The other unit is used for the empty mill modulus only. Therefore, the strip width input is counted from the former unit.

When the operator sets up the stand for a new schedule, he closes the roll gap until the desired force is indicated on the roll force indicator, e.g., at 114 (FIG. 4). When this condition exists, there will be an output from the empty mill modulus summer 106 and its force multiplier 108 which is equivalent to the actual mill stretch $RF/M_1$ at that time. There will also be an output from the conventional mill modulus summer 4 which is equivalent to the mill stretch $RF/M_2$ existing when the same roll force is applied to the stand while it is rolling a strip of the width set on the strip adjustment (P' in FIG. 3A). The difference on line 112 due to analog subtracter 111 provides the quantity $RF/M_1$-$RF/M_2$. This is the error which will exist if the mill is set as previously described, the strip width effects being ignored. This quantity will always be a negative number ($\Delta S$) because, for the same total force, the total mill deflection will be greater with strip in the mill than with an empty mill. Accordingly, the desired thickness (DT) is inputted on line 118 as a positive input (+DT).

The desired strip thickness DT will be set on thumbwheel 113 as shown in FIG. 4. The thickness converted to an analog quantity by the D/A converter is a signal having always a positive value. The actual amount that the roll gap should be opened is the positive value of desired strip thickness minus the absolute value of $|RF_1/M_1-RF_1/M_2|$, where the negative sign indicates that $RF_1/M_2$ is always negative. Accordingly, the new value is obtained by summing the positive and negative values in amplifier 119 to obtain ($H1-\Delta S$). This quantity is the desired change in roll gap $\Delta RGP$ to properly set the roll gap after the predicted force has been preset. This quantity is represented by ($DT-RF_1/M_1-RF_1/M_2$) on curve #2 of FIG. 2. Therefore, once the operator has satisfied himself that the proper force has been set on the mill, he can read the digital voltmeter 116 displaying the new desired position of the roll gap needed to produce the thickness of strip as set on the thumbwheel switch 113. This value will be retained in memory 125 so that it will remain on display after the gap is changed.

When the operator knows the new desired position, he manually opens the gap until the actual position display at 115 matches the desired position display at 116. Once this is done, the stand roll gap is correctly preset at $H_1$ for the roll force condition according to strip width and for the strip thickness desired by the operator.

In contrast to FIG. 4 which illustrates in block diagram the overall scheme of calibration of the stand roll gaps of an automatic gauge control system of a rolling mill, FIG. 5 illustrates also in block diagram, only the particular factors which need to be added to an existing automatic gauge control system of the prior art in order to fully implement the instant invention. Accordingly, FIG. 5 shows the added empty mill modulus summer 106 and the associated multiplier 108 which combines the output signal on line 107 from summer 106 and the function of roll force from line 102 diplayed by digital voltmeter 114. The output of multiplier (108) on line 110 is combined with the output of the multiplier 10 (FIG. 4) on line 109 to derive $\Delta S=(RF/M_1=RF/M_2)$ by subtracting the signal of line 109 from the signal of line 110 to provide $\Delta S$. A thumbwheel 113 is added which, coupled to the D/A converter 117, provides on line 118 the quantity DT, e.g. the desired thickness. Block 119 is another subtracter which, from the signals of lines 112 and 118, generates the quantity $DT-\Delta S$ of line 120.

The new desired position is obtained through block 123 by reference to the actual position derived on line 122 (from the roll gap position transducer of FIG. 4) and as displayed by digital voltmeter 115. A memory 125 stores, at the proper time, the position given by block 123 and the display at the output from line 126 to digital voltmeter 116 indicates the desired position.

Figure 6:
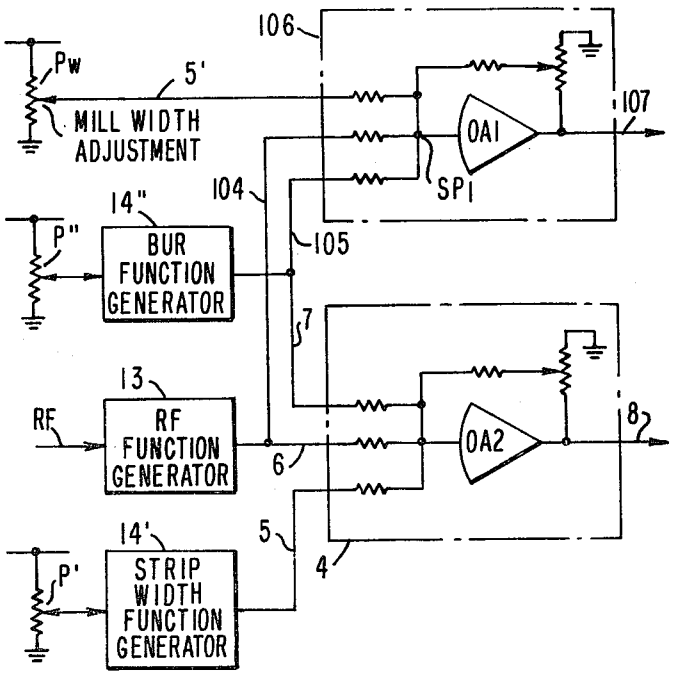

Referring to FIG. 6, the circuitry involved with blocks 4 and 106 of FIG. 4 is shown to contain operational amplifiers OA1, OA2, both responsive to the roll force function generator 13 and the back-up roll function generator 14'' (FIG. 3A) at respective summing points $SP_1$ for OA1 and $SP_2$ for OA2. The mill width parameter is adjusted by potentiometer Pw once for full mill width, and the adjusted value from line 5' is summed up at $SP_1$ of OA1 with the signals of lines 104 and 105 from respective function generators 13 and 14''. This is for the empty mill modulus summer 106. The loaded will modulus summer 4 is responsive on line 5 at summing point $SP_2$ to the output of a strip width function generator adjusted by potentiometer P' in accordance with actual width of a strip being run through the rolling mill.

Figure 7:
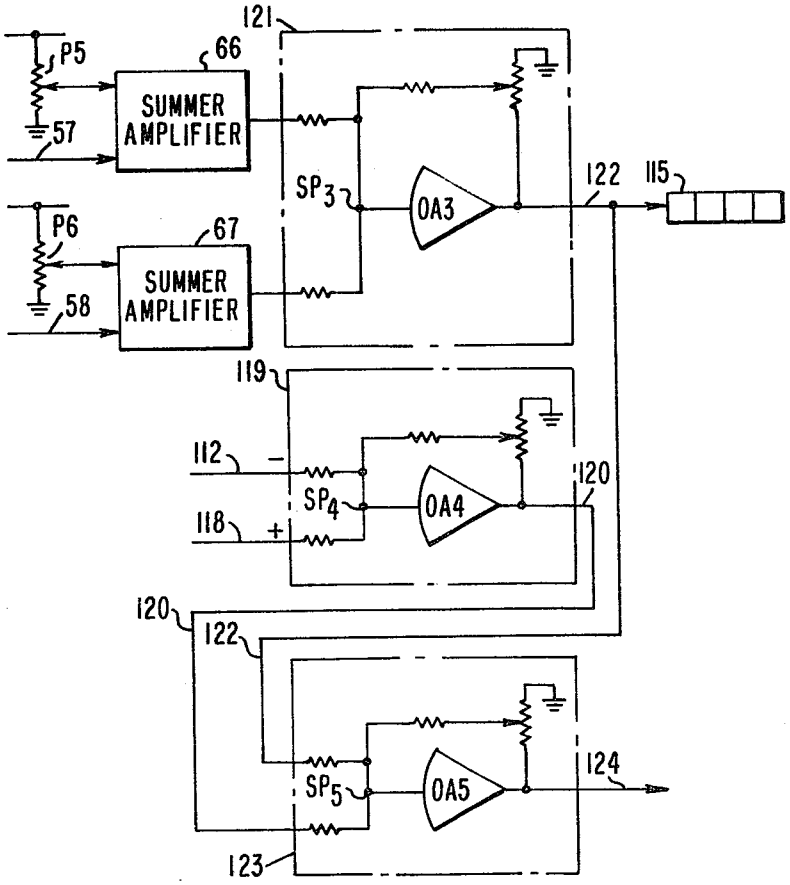
FIGS. 6 and 7 show hardware circuitry as can be used to implement the function of FIG. 5.

Referring to FIG. 7, circuit 119, 121 and 123 of FIG. 4 contain operational amplifiers OA4, OA3 and OA5, respectively, having corresponding summing points $SP_4$, $SP_3$, $SP_5$. Summer amplifiers 66 and 67 (FIG. 3B) provide signals which are summed up to input at point $SP_3$ of OA3 in block 121, while the negative signal of line 112 and the positive signal of line 118 are summed up at input point $SP_4$ of OA5 in block 119. In the same way, summing point $SP_5$ of OA5 adds up the signals of output line 120 from block 119 and output line 122 from block 121, at the input of OA5 in block 123. The overall result is a signal on line 124 which leads at the output of block 121 to a zeroing of the desired position away from the present actual position displayed by digital voltmeter 115.

Figure 8:
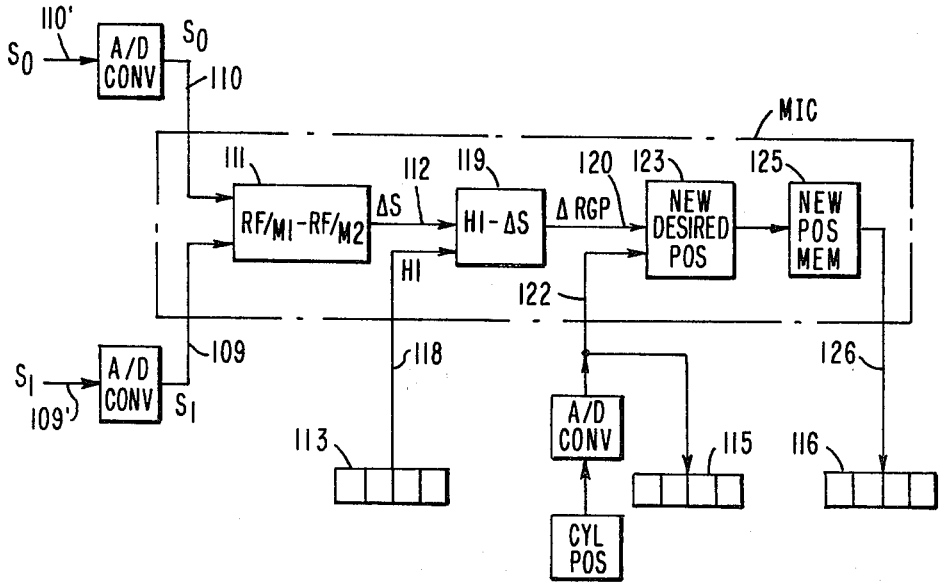
FIG. 8 shows how a microprocessor can be used to accomplish the main functions shown on FIG. 5.

Referring to FIG. 8, the added functions specified in FIG. 5 and represented by blocks 111, 119, 123 and 125 are shown within dotted lines at MIC to illustrate a flow chart arrangement within a microprocessor to respond to digital data from lines 109, 110, 118 and 122 to provide on the output line 126 a digital representation of the computed desired position reached in accordance with the setting of thumbwheel 113.

I claim:

1. A method of presetting the roll stands of a rolling mill comprising the steps of:

closing the roll gap of a roll stand until a desired roll force RF is developed between the rolls;

determining the actual mill stretch $RF/M_1$ of the empty mill modulus for said desired roll force at said stand;

determining for said desired roll force the actual mill stretch $RF/M_2$ of the mill modulus at said stand if loaded with a strip of material of a given width;

calculating the quantity $\Delta S=(RF/M_1-RF/M_2)$;

determining for a desired strip thickness DT a desired roll gap opening $H_1$ by the relation $H_1=DT-(S_1-S_0)$, where $S_0$ is the separation of the rolls when the mill is empty and $S_1$ is the separation of the rolls when the mill is loaded; and opening the roll gap of said stand by an amount sufficient to reach said desired roll gap opening.

2. The method of claim 1 with said actual mill stretch of the loaded mill modulus determining step being effected in relation to the strip width.

3. The method of claim 2 with said actual mill stretch of the loaded mill modulus determining step being further effected in relation to the diameter of the back-up rolls at said stand.

4. The method of claim 2 or 3 wth the provision of a display of the actual roll gap opening and a display of the desired roll gap opening as determined by said desired roll gap opening determining step, said roll gap opening step being performed by matching the display of the actual roll gap opening with the display of the desired roll gap opening.

5. Apparatus for inwardly presetting the roll stand so of a rolling mill comprising:

means for closing the roll gap of a roll stand until a desired roll force RF is developed between the rolls;

first means for deriving the actual mill stretch $RF/M_1$ of the empty mill modulus for said desired roll force;

second means for deriving the actual mill stretch $RF/M_2$ of the mill when loaded with strip material in relation to the loaded mill modulus at said stand for said desired roll force means for calculating the quantity $(RF/M_1-RF/M_2)$;

third means for estimating a desired roll gap opening $H_1$ from the amount of a desired strip thickness $\Delta T$ less $(RF/M_1-Rf/M_2)$; and means for opening the roll gap of said stand by an amount sufficient to reach said estimated desired roll gap opening.

6. The apparatus of claim 5 with said second means being operative in relation to the strip width.

7. The apparatus of claim 6 with second means being further operative in relation to the back-up roll diameter at said stand.

8. The apparatus of claim 5 or 6 with first digital voltmeter means being provided for displaying the actual roll gap opening at said stand; second digital voltmeter means being provided in response to said third means for displaying the desired roll gap opening; said roll gap opening means being operated by matching the display of the actual gap opening with the display of the desired gap opening.

9. The apparatus of claim 8 with said third means being responsive to means for manually establishing a reference signal representative of the desired thickness.

10. The apparatus of claim 9 with said reference signal restablishing means including digital thumbwheel means and digital-to-analog converter means responsive to said digital thumbwheel means for generating said reference signal in analog form.

11. The apparatus of claim 9 with said third means including operational amplifier means responsive to said second means and to said reference signal.

12. The apparatus of claim 11 with the roll force of said roll stand being applied by an hydraulic system.

13. The apparatus of claim 12 with roll gap positioning means being provided for indicating actual roll gap opening, said third means and said first digital voltmeter means being both responsive to said roll gap positioning means.

14. The apparatus of claim 12 with said hydraulic system including cylinder means associated with the rolls of said stand for applying roll force thereto; cylinder positioning means being connected to said cylinder means for indicating actual roll gap opening at said stand; said third means and said first digital voltmeter means being both responsive to said cylinder positioning means.

15. The apparatus of claim 8 including a microprocessor responsive to digital signals from said first and second means and representative respectively of $RF/M_1$ and $RF/M_2$ for generating a first digital signal representative of $\Delta S=(RF/M_1-RF/M_2)$; said microprocessor being further responsive to a second digital signal representative of a desired strip thickness $H_1$; said microprocessor being also responsive to a third digital signal representative of an actual roll gap opening; said microprocessor combining said first and second signals to provide $(H_1-\Delta S)$ and combining $(H_1-\Delta S)$ with said third signal to generate a digital representation of the desired roll gap opening.

16. The apparatus of claim 15 with a thumbwheel for setting said second digital signal into said microprocessor and for displaying said desired strip thickness.

17. The apparatus of claim 16 with a first digital indicator for displaying said actual roll gap opening in response to said second digital signal.

18. The apparatus of claim 17 with a second digital indicator for displaying said desired roll gap opening in response to said microprocessor.

19. The apparatus of claim 18 with said microprocessor recurrently storing said digital representation of the desired roll gap opening.

* * * * *